United States Patent [19]

Yoshida et al.

[11] Patent Number: 4,974,974

[45] Date of Patent: Dec. 4, 1990

[54] PRINTER CAPABLE OF ADJUSTING SPACING BETWEEN PRINT HEAD AND PRINT PAPER IN SPECIFIED POSITION

[75] Inventors: Yasunari Yoshida; Masaaki Hori, both of Nagoya, Japan

[73] Assignee: Brother Kogyo Kabushiki Kaisha, Nagoya, Japan

[21] Appl. No.: 396,664

[22] Filed: Aug. 22, 1989

[30] Foreign Application Priority Data

Aug. 24, 1988 [JP] Japan ..... 63-210066

[51] Int. Cl.[5] ..... B41J 25/308

[52] U.S. Cl. ..... 400/56; 400/59; 400/279

[58] Field of Search ..... 400/54, 55, 56–58, 400/279, 624

[56] References Cited

U.S. PATENT DOCUMENTS 4,676,675 6/1987 Svzuki ..... 400/56

4,808,019 2/1989 Olson ..... 400/624

FOREIGN PATENT DOCUMENTS 71181 6/1981 Japan ..... 400/55

20684 2/1984 Japan ..... 400/55

*Primary Examiner*—David A. Wiecking

*Assistant Examiner*—Steven S. Kelley

*Attorney, Agent, or Firm*—Oliff & Berridge

[57] ABSTRACT

In the printer of the type in which the spacing between a print head and a sheet of paper supported on a platen can be adjusted depending upon the sheet used, the position in which the spacing is adjusted is freely selectable. When printing is effected on a sheet with tab labels, the position of the print head is specified so that the print head confronts the tab label, and then the spacing between the print head and the face of the print sheet is adjusted upon moving the print head to the specified position.

8 Claims, 5 Drawing Sheets

PRINTER CAPABLE OF ADJUSTING SPACING BETWEEN PRINT HEAD AND PRINT PAPER IN SPECIFIED POSITION

BACKGROUND OF THE INVENTION

The present invention relates to a printer which is capable of adjusting the spacing between a print head and the face of a print sheet, end more particularly to an improvement in which the spacing adjusting position can freely be selected.

Various printers have been proposed which have spacing adjusting means for adjusting the spacing between a print head and the face of a print sheet. For example, Japanese Laid-Open Patent Publications Nos. 60-18377 and 62-187065 propose such printers. In these known printers, the spacing can be adjusted depending on the sheet used and the adjustment of the spacing is achieved by moving the print head toward and away from a platen of the printer. However, the spacing adjusting position is fixed irrespective of the kind of the sheet used, and therefore, the following drawbacks have been noted.

A sheet with tab labels attached has an irregular thickness, since it is thicker where these tab labels are present and thinner where no tab labels are present. Therefore, the face of the sheet is irregular in the transverse direction of the sheet, i.e., in the longitudinal direction of the platen. If this sheet is used in the printer, the spacing between the print head and the face of the print sheet has to be adjusted with respect to one of the tab labels which is to be printed. To adjust the spacing between the print head and this sheet, the operator is required to stop the print head at one of these tab labels. The procedure to stop the print head at a tab label has been very tedious and time-consuming.

SUMMARY OF THE INVENTION

In view of the aforesaid drawbacks, it is an object of the present invention to provide a printer which can freely select a position where the spacing between the print head the face of a print sheet is to be adjusted.

In order to achieve the above and other objects, as shown in FIG. 1, there is provided a printer comprising a platen 11 for supporting a print sheet p, the platen 11 having a longitudinal axis, a print head 15 for performing a printing operation on the print sheet P supported on the platen 11 the print head 15 being movably disposed in a line extending in parallel to the longitudinal axis in confronting relation to the platen 11, moving means 1 for reciprocally moving the print head 15 along the line, spacing adjusting means 4 for adjusting a spacing Δh between the print head 15 and the print sheet P, operating means 2 for specifying a position on the line where the spacing Δh is adjusted by the spacing adjusting means 4, the operating means 2 producing a signal indicative of the specified position, and control means 3 operably connected to the operating means 2 for controlling the moving means 1 to move the print head 15 to the specified position in response to the signal.

The printer thus arranged operates as follows. To adjust the spacing Δh, the operator of the printer specifies a position in which the spacing is to be adjusted through the operating means 2. In response to the signal from the operating means 2, the control means 3 controls the moving means 1 to move the print head 15 to the specified position, thus varying the position where the print head 1 confronts the platen 2 in the longitudinal direction thereof.

After the print head 15 is positioned in the desired position in confronting relation to the face of the print sheet P interposed in the gap between the print head 15 and the platen 11, the spacing Δh between the print head 15 and the face of the print sheet P is adjusted to a desired dimension by the spacing adjusting means 4.

With the present invention, when the spacing Δh is to be adjusted, a position in which the spacing is to be adjusted can be selected as desired simply by depressing the relevant keys on the operating means 2. The spacing Δh can thus be adjusted in the intended position depending on the kind of the sheet used. The spacing Δh can simply be adjusted in a proper position especially when a sheet with tab labels thereon is used.

The above and other objects, features and advantages of the present invention will become more apparent from the following description When taken in conjunction with the accompanying drawings in which a preferred embodiment of the present invention is shown by way of illustrative example.

DETAILED DESCRIPTION OF THE PREFERRED EMBODIMENTS

The expression "front", "rear", "right" and "left" are used throughout the description to define the various parts when the printer is disposed in an orientation in which it is intended to be used.

Figure 1:
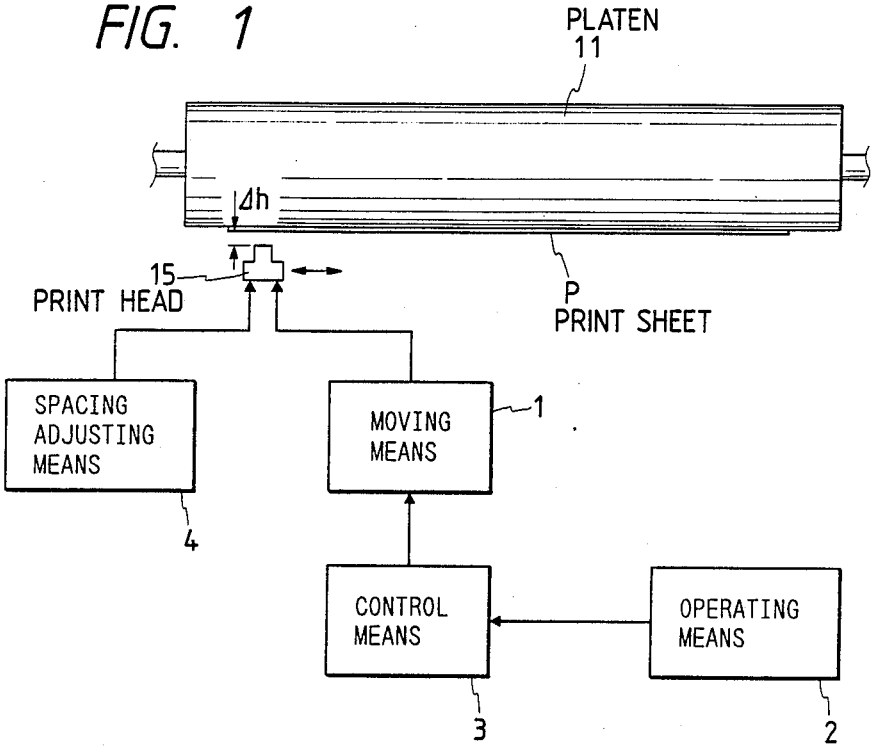
FIG. 1 is a block diagram of a printer according to the present invention.
Figure 2:
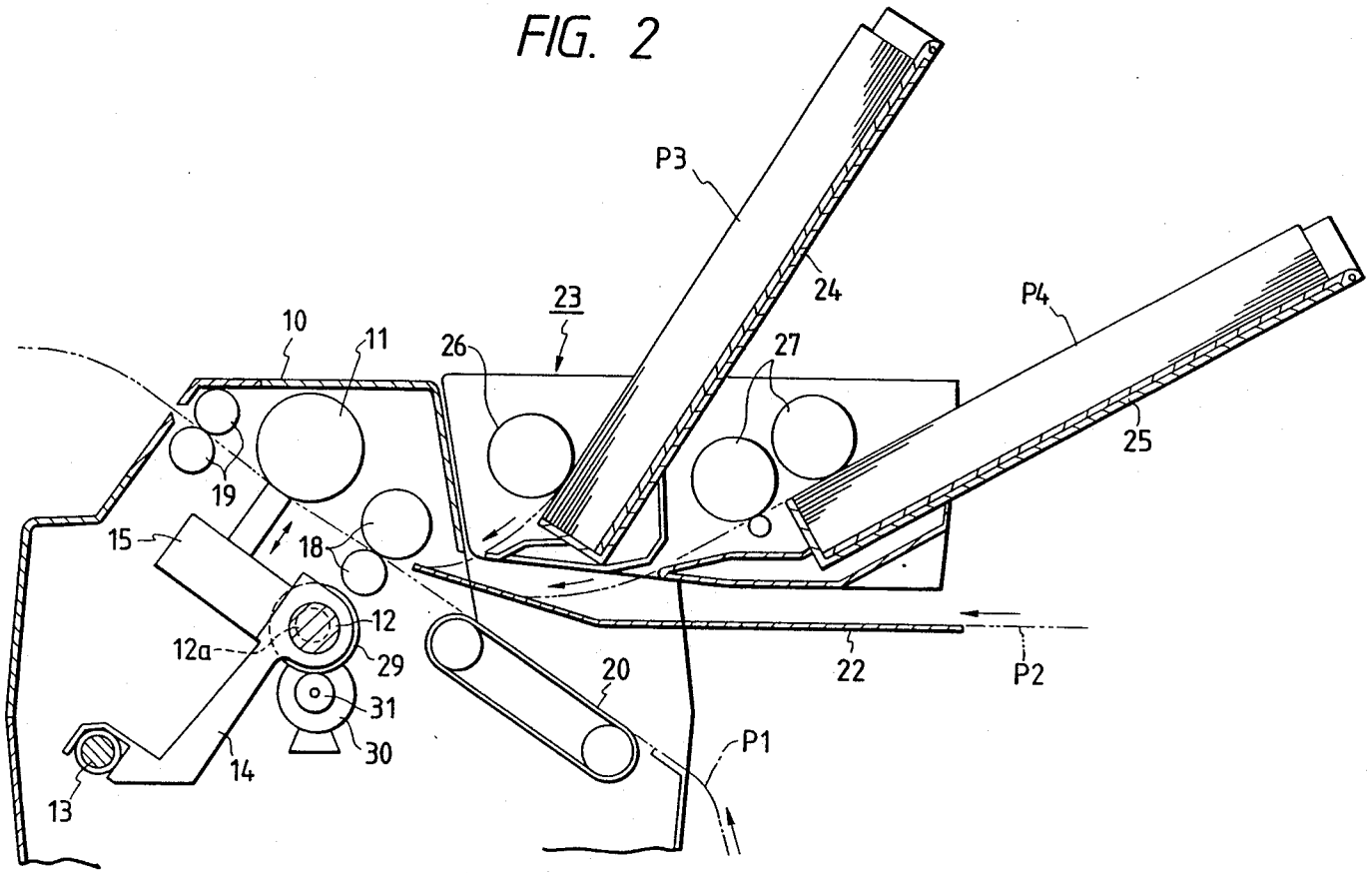
FIG. 2 is a fragmentary cross-sectional view of a print mechanism and components in association therewith.
Figure 3:
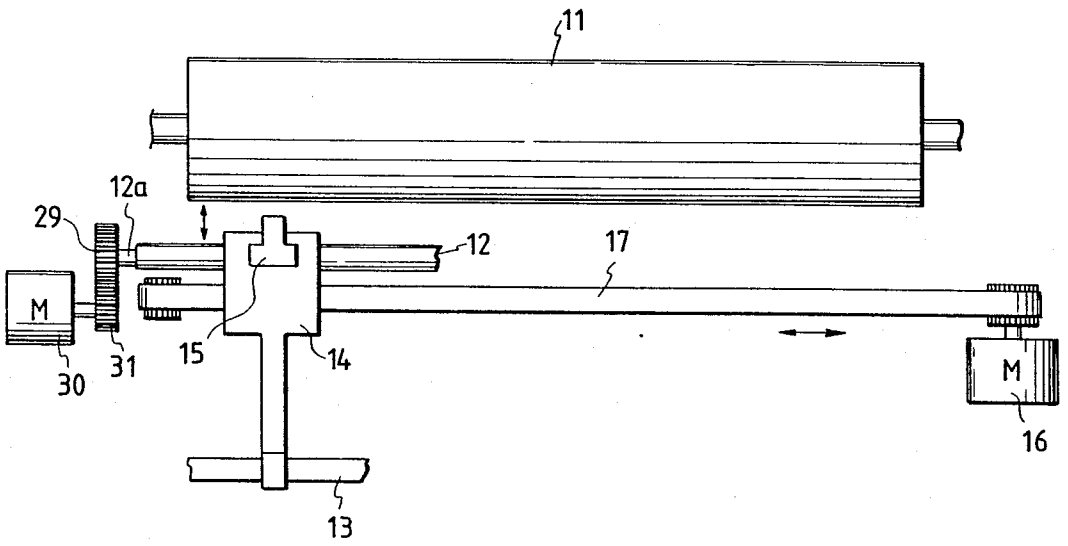
FIG. 3 is a schematic plan view of the print mechanism and components in association therewith.

As shown in FIG. 2, the printer has a housing in which a platen 11 is rotatably supported. Specifically, the platen 11 has a longitudinal axis extending perpendicular to the sheet of drawing, end the both ends of the platen 11 are rotatably supported in the housing 10. Two guide rods 12, 13 are disposed in parallel to the platen 11. The guide rod 12 is positioned directly below the platen 11, whereas the guide rod 13 is positioned below and forwardly of the platen 11. The guide rods 12, 13 support a carriage 14 so that the carriage 14 is movable longitudinally along the guide rods 12, 13. A print head 15 is mounted on the carriage 14 in confronting relation to the platen 11. As shown in FIG. 3, the print head 15 is movable with the carriage 14 reciprocally along the guide rods 12, 13 when the carriage 14 is driven by a reversible motor 16 through a belt 17 connected to the carriage 14. The carriage motor 16 and the belt 17 jointly correspond to the moving means 1 shown in FIG. 1.

Referring again to FIG. 2, a pair of feed rollers 18 and another pair of feed rollers 19 ere disposed one on each side of the platen 11 for feeding a sheet of print paper into the gap between the print head 15 and the platen 11. A pin tractor 20 is located upstream of the feed rollers 18 with respect to the direction in which the sheet is fed. A continuous sheet P1, such as a sheet with tab labels, is fed by the pin tractor 20 into the printing area in the gap between the print head 15 and the platen 11. The feed rollers 18, 19 and the pin tractor 20 are coupled to a single sheet feed motor 21 shown in FIG. 4 and hence can be rotated thereby in synchronization with one another.

A manual sheet feed guide plate 22 is substantially horizontally supported in the housing 10 above the pin tractor 20 and partly projects out of the housing 10. A single sheet P2, such as a sheet of a particular size or an envelop, can be manually fed over the guide plate 22 toward the rollers 18. An automatic cut sheet feeder (ACSF) unit 23 for automatically feeding cut sheets is detachably mounted on the housing above the guide plate 22. The ACSF unit 23 has a pair of stackers or trays 24, 25 which store stacks of sheets P3, P4, such as single sheet, envelopes, and feed rollers 26, 27 for feeding the sheets P3, P4 one at time from the stackers 24, 25. The feed rollers 26, 27 are coupled to reversible feed motor 28 (see FIG. 4) through a selector means (not shown) and hence are rotatable thereby.

Referring again to FIG. 3, the guide rod 12 has a pair of eccentric shafts **12*a* on its opposite ends (only one shaft 12*a* is shown). The shafts 12*a* are connected to the end faces of the guide rod 12 in offset relation and are rotatably supported on opposite sides panels of the housing 10. One of the eccentric shafts 12*a* supports a gear 29 through a slip clutch (not shown), the gear 29 meshing with a gear 31 fixedly mounted on the shaft of a spacing adjusting motor 30. When the gear 31 is rotated clockwise (FIG. 2) about its own axis by the motor 30, the eccentric shaft 12*a* is rotated counterclockwise through the gear 29 and the slip clutch. Then, the central axis of the guide rod 12 is displaced to move the carriage 14 and the print head mounted thereon toward the platen 11. When the motor 30 is reversely rotated, the print head 15 is moved away from the platen 11. The motor 30, the eccentric shafts 12*a* attached to the guide rod 12, and the gears 29, 31 serve as the spacing adjusting means 7 shown in FIG. The spacing between the platen 11 and the print head 15 may be varied, for example, by moving the print head 15 toward the face of the sheet until the tip of the print head 15 abuts against the face of the sheet, and then moving the print head 15 a fixed distance away from the face of the sheet so that the spacing $\Delta h$ between the tip of the print head 15** and the face of the sheet will be adjusted to a fixed distance.

According to the printer of the embodiment, a position in which the spacing is adjusted can be specified as desired.

Figure 4:
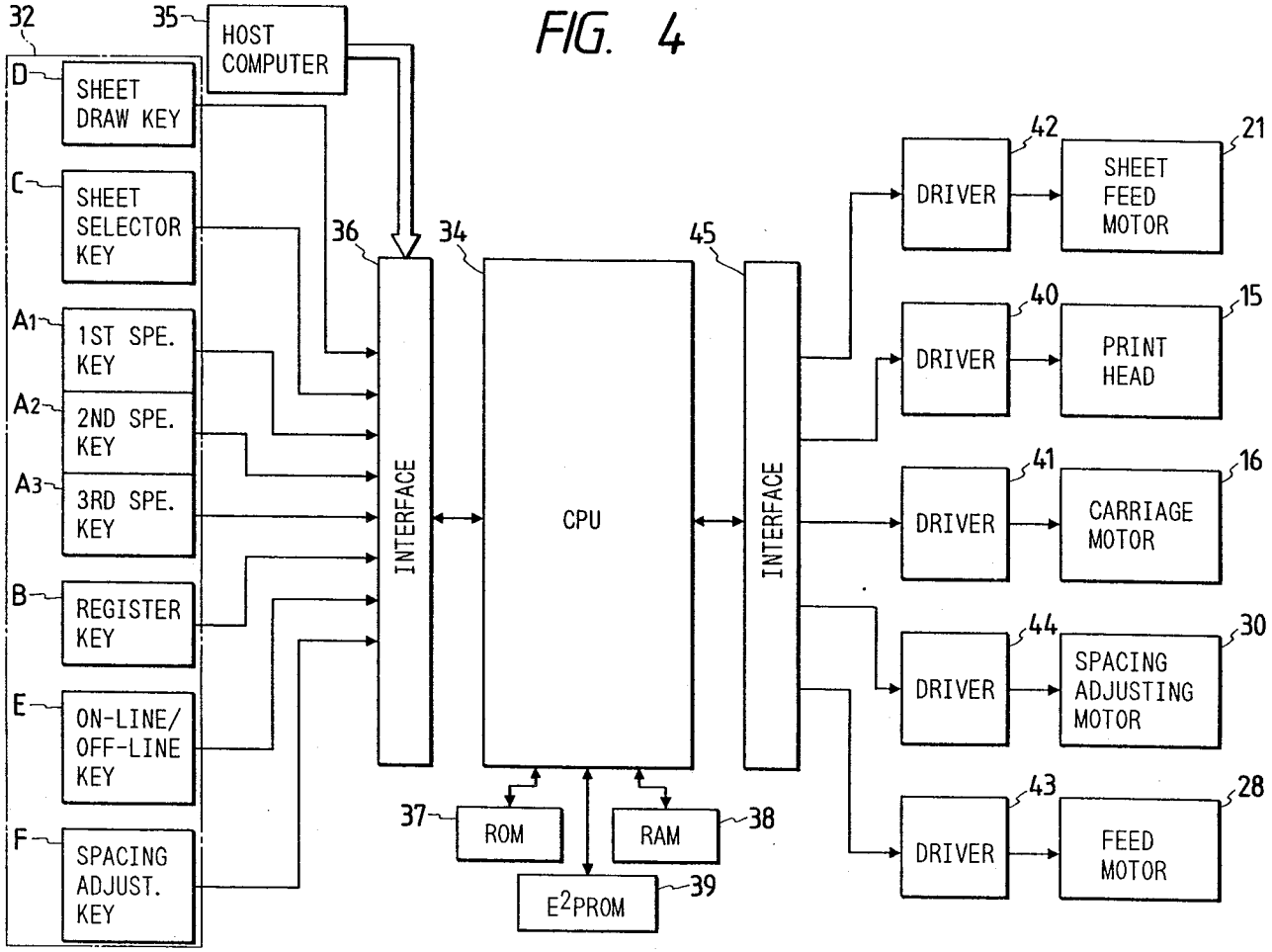
FIG. 4 is a block diagram of the printer.

As shown in FIG. 4, the housing 10 supports an operating panel 32 on its outer surface. The operating panel 32 includes at least first through third specifying keys A1, A2 and A3 for specifying a spacing adjusting position in the longitudinal direction of the platen 11, a register key B for storing the specified position as default data, a sheet selector key C, a sheet draw key D for drawing a sheet, an on-line/off-line mode selector key E, end a spacing adjusting position setting mode key F.

Operation initiated by these keys will be described.

The first through third specifying keys A1 through A3 correspond to the operating means 2 shown in FIG. 1. Each time the first specifying key A1 is depressed the carriage 14 is moved from left to right in FIG. 3 over a first interval stored in a ROM 37. Each time the second specifying key A2 is depressed, the carriage 14 is moved from right to left in FIG. 2 over the first interval. Each time the third specifying key A3 is depressed, the carriage 14 is moved from left to right in FIG. 2 over a second interval larger than the first interval. By operating these three keys A1 through A3 in an appropriate combination, the carriage 14 can be moved to a desired position.

When the register key B is depressed, the spacing adjusting position specified by the specifying keys A1 through A3 is stored in an electrically erasable programmable read-only memory ($E^2$OROM) 39.

By the depression of the sheet selector key C, one of the following modes can be selected: a continuous feed mode in which a continuous sheet P1 is supplied by the pin tractor 22, a manual feed mode in which sheet P2 is supplied over the manual feed guide plate 22, an ACSF(I) mode in which a sheet P3 stored in the first stacker 24 is supplied, and an ACSF(II) mode in which a sheet P4 in the second stacker 25 is supplied.

When the sheet draw key D is depressed, the pin tractor 20 or the feed rollers 26, 27 are driven, and a sheet is fed to the print mechanism in the mode which has been selected by the sheet selector key C.

When the on-line/off-line mode selector key E is depressed, the printer switches between an on-line mode and an off-line mode. In the on-line mode, the printer can receive data transmitted from a host computer 35 whereas in the off-line mode, the printer cannot receive data from the host computer 35.

By the depression of the spacing adjusting position setting mode key F, the position of the print head 15 and the carriage 14 can be varied.

FIG. 4 shows in block form the printer which includes a central processing unit (CPU) 34 which corresponds to the control means 3 in FIG. 1. To the CPU 34, there are connected through an interface 36 the host computer 36 and the keys on the operating panel 32. The CPU 34 is also connected to a ROM 37, RAM 38 and a non-volatile electrically erasable read-only memory ($E^2$PROM). In the ROM 37, there are stored a program for controlling the entire operation of the printer and a program for controlling an operation sequence shown in FIG. 5. In the RAM 39, print data fed from the host computer 35 is temporarily stored. In the $E^2$PROM, stored are the data regarding the spacing adjusting position selected by the combination of the first through third specifying keys A1 through A3 depending on the mode selected by the sheet selector key C and on the status of the spacing adjusting position which has been stored in the $E^2$PROM. To the CPU 34, there are also coupled through an interface 45 the print head 15, the carriage motor 16, the feed motor 21, the sheet feed motor 28, the spacing adjusting motor 30, and their associated drivers 40 through 44.

Figure 5:
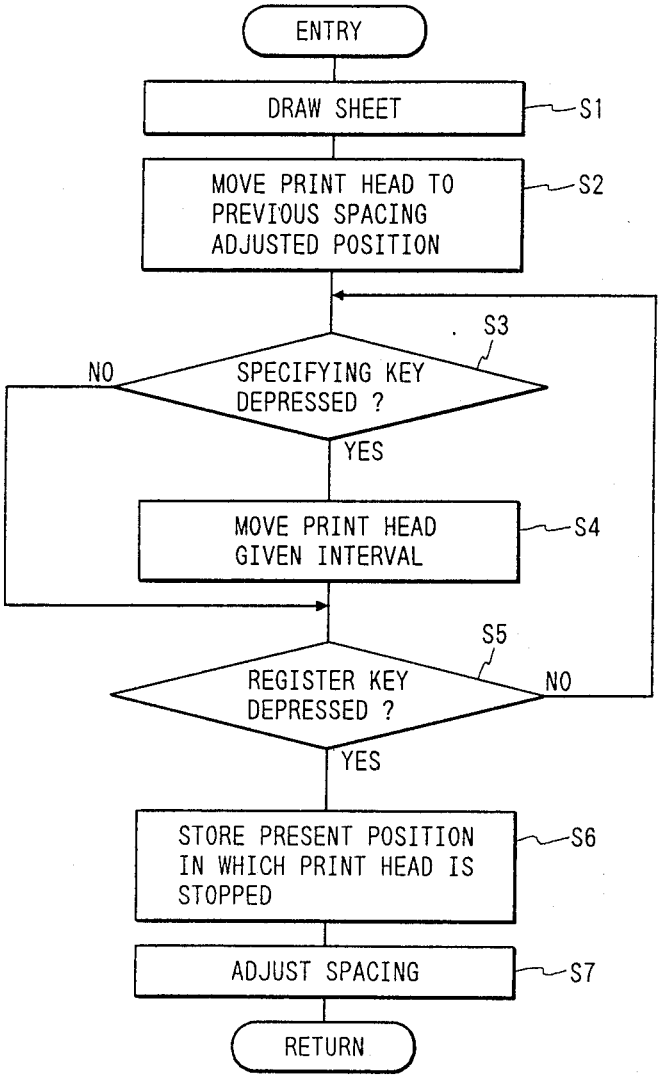
FIG. 5 is a flowchart for description of an operation sequence of the printer.

Operation of the printer thus arranged will be described with reference to the flowchart of FIG. 5.

The one-line/off-line mode selector key E is depressed to put the printer in the off-line mode, and the spacing adjusting position setting mode key F is depressed. Control then enters the routine shown in FIG. 5. The sheet selector key C is depressed to select a sheet mode in which the spacing adjusting position is to be modified. The sheet draw key D is next depressed to draw one of the sheets P1 through P4 corresponding to the selected sheet mode for feeding the sheet into the gap between the platen 11 and the print head 15 (step S1).

The data regarding the spacing adjusting position which has been selected in the previous print cycle and presently registered are read out of the E²PROM 39, and the carriage motor 16 is controlled based on the data thus read to move the carriage 14 to the previously selected position on a line parallel to the longitudinal axis of the platen 11 (step S2).

Thereafter, it is determined in step S3 whether the first through third specifying keys A1 through A3 have been depressed or not. If yes, then the routine proceeds to step S4, and if not, then the routine jumps to step S5 skipping step S4.

In step S4, it is recognized which specifying key has been depressed and data corresponding to the depressed key is read out of the ROM 37. The data thus read out indicates a predetermined interval over which the carriage 14 is to be moved. Depending upon the kind of the specifying keys and the number of times the specifying key is depressed, the carriage motor 16 is controlled so as to move the carriage 14 from the present stop position over a wanted interval in the given direction.

Figure 6:
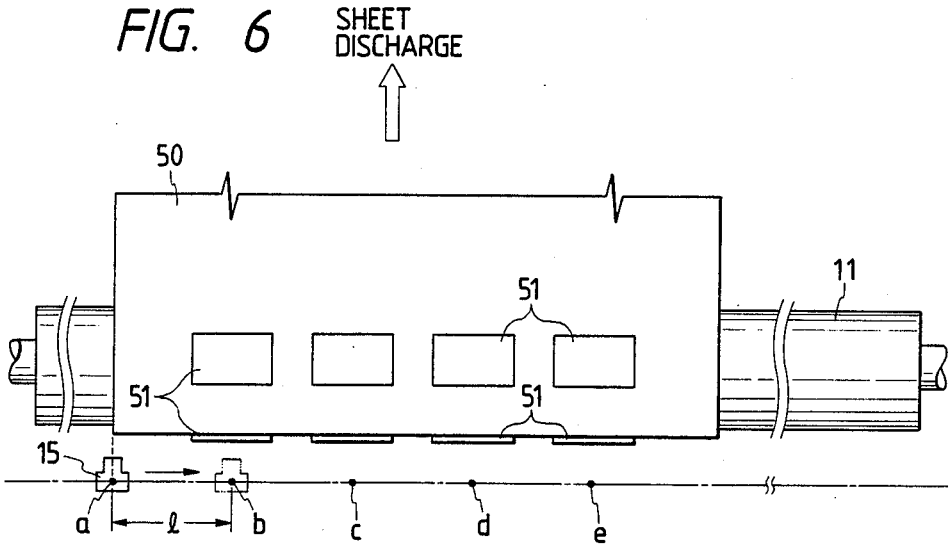
FIG. 6 is a schematic plan view illustrating operation of the printer.

In step S5, it is determined whether the register key B has been depressed or not. If depressed, the routine proceeds to step S6, and if not, then the routine returns to step S3. Steps S3, S4 and S5 are repeated until the register key B is depressed in step S5. In step S6, the data regarding the spacing adjusting position which have been stored in the E²PROM 29 are erased, and the updated position in which the carriage 14 is stopped is newly stored as default data in the E²PROM 39. Thereafter, the spacing Δh between the print head 15 and the face of the print sheet is adjusted by the spacing adjusting means 4 (step S7). The spacing Δh is adjusted by energizing the motor 30 to move the print head 15 toward the platen 11 until the print head 15 is held against the platen 11. Thereafter, while reading the spacing data out of the ROM 37, the rotational direction of the motor 30 is reversed to move the print head 15 away from the platen 11 by an interval indicated by the spacing data reed out of the ROM 37. When the spacing adjusting step is completed, the entire routine shown in FIG. 5 is terminated. A process of setting a spacing adjusting position when a sheet with tab labels is used will be described below in specific detail. As shown in FIG. 6, a sheet 50 has on its face four tab labels 51 spaced at regular intervals in the transverse direction of the sheet. The print face of the sheet 50 has a leftside edge aligned at a point a on the platen 11 and the print head 15 is positioned at the point a in confronting relation to the platen 11 as indicated by dotted lines. Since the tab labels 51 are spaced at regular intervals, the print head 15 must be moved by the carriage 14 over predetermined intervals so that the print head 15 is positioned in confronting relation to one of positions *b* through e where the tab labels 51 are present. In this case, the first through third specifying keys A1, A2 and A3 are depressed as many times as desired to energize the carriage motor 16 to enable the carriage 14 to move the print head 15 to the closest point b , so that the print head 15 faces the corresponding tab label 51. The tab label 51 can be aligned with the print head 15 by feeding the sheet 50 with the sheet feed motor 21 in the sheet feeding direction perpendicular to the longitudinal axis of the platen 11. Thereafter, the spacing Δh between the print head 15 and the face of the tab 51 is adjusted to a prescribed dimension in the position b by the motor 30 and the belt 31.

In normal printing operation, each time a new sheet is introduced into the print mechanism, the data which have been stored in the E²PROM 39 are read out, and the print head 15 is moved to the position indicated by the data thus read out, whereupon the spacing is adjusted.

Although the present invention has been described with reference to a specific embodiment, it should be understood that a variety of changes and modifications may be made without departing from the scope and spirit of the invention. For example, the sheet drawing step in step 1 may be performed before the spacing adjusting position setting mode key F is depressed. Further, while storing in the ROM 37 an initial spacing adjusting position, the E²PROM 39 may be rewritten to the initial spacing adjusting position rather than maintaining the updated spacing adjusting position therein by operating a reset key (not shown) on the operating panel 32 or certain keys in combination.

In the above-described embodiment, the print head 15 is moved fixed intervals by depressing the first through third specifying keys A1 through A3. However, a modification may be made so that the print head is continuously moved by operating these keys in combination with another key. Further modification may be made so that certain positions are determined in advance and the print head is instructed to which position it should be moved. In another modification, optimum spacing adjusting positions may be stored in a memory depending on the kinds of sheets to be used, and the optimum spacing adjusting position may be read out in response to the selection of the sheet mode with the sheet selector key C so that the print head 15 may be moved to the spacing adjusting position thus read out. In addition, the print head 15 may be moved longitudinally along the platen 11 by any of other mechanisms than described above in the foregoing embodiment.

What is claimed is:

1. A printer comprising:

a platen for supporting a print sheet, said platen having a longitudinal axis;

a print head for performing a printing operation on the print sheet supported on said platen, said print head being movably disposed in a line extending in parallel to the longitudinal axis in confronting relation to said platen;

moving means for reciprocally moving said print head along the line;

spacing adjusting means for adjusting a spacing between said print head and the print sheet;

operating means for specifying a position on the line where the spacing is adjusted by said spacing adjusting means, said operating means producing a signal indicative of the specified position;

instructing means for producing an instruction for instructing said print head to move to the position on the line where the spacing is adjusted by said spacing adjusting means, said operating means producing a signal indicative of the specified position in response to the instruction;

control means operably connected to said operating means for controlling said moving means to move said print head to the specified position in response to the signal;

said operating means comprises at least one key, the position where the spacing is adjusted being determined by a number of times said key is depressed;

first storage means for storing the signal indicative of the specified position; and the number of times said key is depressed being stored in said first storage means.

2. A printer according to claim 1, wherein said control means controls said moving means upon reading the signal out of said first storage means.

3. A printer according to claim 2, wherein said first storage means comprises an electrically erasable programmable read-only memory device.

4. A printer according to claim 3, wherein said memory device erases the signal stored therein and stores another signal produced each time the position is specified by said operating means.

5. A printer according to claim 3, further comprising second storage means for storing a second signal indicative of a predetermined position where the spacing is adjusted by said spacing adjusting means, and wherein said memory device erases the signal stored therein and stores another signal produced when the position is newly specified by said operating means, and thereafter replaces the another signal with the second signal.

6. A printer according to claim 2, wherein said operating means comprises a plurality of keys, the position where the spacing is adjusted being determined by the keys depressed and a number of times each of the keys is depressed, and the keys depressed and the number of times being stored in said first storage means.

7. A printer according to claim 1, further comprising sheet supplying means for selectively supplying different types of sheets into a gap between said print head and said platen, and sheet selecting means for causing said sheet supplying means to supply a specified sheet among the different types of sheets.

8. A printer according to claim 7, further comprising third storage means for storing a third signal indicative of an optimum position where the spacing is adjusted by said spacing adjusting means depending on each of the different types of sheets, and wherein said control means controls said moving means to move said print head to the optimum position in response to the third signal read out of said third storage means corresponding to the sheet specified by said sheet selecting means.

* * * * *